US010746435B2

(12) United States Patent
Muramatsu et al.

(10) Patent No.: US 10,746,435 B2
(45) Date of Patent: Aug. 18, 2020

(54) DRAINAGE STRUCTURE FOR AIR CONDITIONER

(71) Applicant: Hitachi-Johnson Controls Air Conditioning, Inc., Tokyo (JP)

(72) Inventors: Naoki Muramatsu, Tokyo (JP); Hajime Sasaki, Tokyo (JP); Kouji Yonekura, Tokyo (JP); Kazuho Hirao, Tokyo (JP); Ryou Shibusawa, Tokyo (JP); Hiroki Kinoshita, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 83 days.

(21) Appl. No.: 16/073,829

(22) PCT Filed: Dec. 20, 2016

(86) PCT No.: PCT/JP2016/087909
§ 371 (c)(1),
(2) Date: Jul. 30, 2018

(87) PCT Pub. No.: WO2017/138262
PCT Pub. Date: Aug. 17, 2017

(65) Prior Publication Data

US 2019/0041088 A1 Feb. 7, 2019

(30) Foreign Application Priority Data

Feb. 8, 2016 (JP) ..... 2016-021449

(51) Int. Cl.
*F24F 13/22* (2006.01)
*F24F 13/20* (2006.01)

(52) U.S. Cl.
CPC ..... *F24F 13/222* (2013.01); *F24F 13/20* (2013.01); *F24F 13/22* (2013.01)

(58) Field of Classification Search
CPC ..... F24F 13/222; F24F 13/20; F24F 13/22
See application file for complete search history.

(56) References Cited

U.S. PATENT DOCUMENTS 5,212,958 A * 5/1993 Anderson ..... B01D 5/009 417/36
6,286,817 B1 * 9/2001 Grant ..... F02M 5/12 116/276

(Continued)

FOREIGN PATENT DOCUMENTS

JP 7-12366 A 1/1995
JP H0712366 A * 1/1995

(Continued)

OTHER PUBLICATIONS

Communication Pursuant to Rule 164(1) EPC received in corresponding European Application No. 16889963.1 dated Sep. 17, 2019.

(Continued)

*Primary Examiner* — Frantz F Jules
*Assistant Examiner* — Lionel Nouketcha
(74) *Attorney, Agent, or Firm* — Mattingly & Malur, PC

(57) ABSTRACT

In order to enable a drain pan to be visually checked for contamination without requiring a complicated operation, the present invention is configured so as to be equipped with: a housing; a drain pan provided inside the housing; a drain pump for pumping up drain water accumulated in the drain pan; an opening provided in a side surface of the housing; and a cover member attached to the opening and covering the opening. When the cover member is detached from the opening at least a portion of the drain pan can be viewed from the opening.

5 Claims, 5 Drawing Sheets

(56) References Cited

U.S. PATENT DOCUMENTS

| | | | | |
|---|---|---|---|---|
| 8,156,956 | B1 * | 4/2012 | Coogle | F16L 55/07 137/240 |
| 9,243,947 | B2 * | 1/2016 | Stewart | F24F 13/22 |
| 2007/0169493 | A1 * | 7/2007 | Rios | F24F 13/222 62/285 |
| 2008/0047289 | A1 * | 2/2008 | Patrick | B63J 2/04 62/285 |
| 2009/0071181 | A1 | 3/2009 | Spanger | |

FOREIGN PATENT DOCUMENTS

| | | | |
|---|---|---|---|
| JP | 10-267310 | A | 10/1998 |
| JP | 2000-274877 | A | 10/2000 |
| JP | 2002-130729 | A | 5/2002 |
| JP | 2008-209037 | A | 9/2008 |
| JP | 2008-309468 | A | 12/2008 |
| JP | 2011-027328 | A | 2/2011 |
| JP | 2012-225524 | A | 11/2012 |
| JP | 2014-137202 | A | 7/2014 |

OTHER PUBLICATIONS

International Search Report of PCT/JP2016/087909 dated Mar. 7, 2017.

Japanese Office Action received in corresponding Japanese Application No. 2016-021449 dated Jun. 2, 2020.

* cited by examiner

DRAINAGE STRUCTURE FOR AIR CONDITIONER

TECHNICAL FIELD

The present invention relates to an air conditioner.

BACKGROUND ART

In an air conditioner, a drain pan for receiving drain water from a heat exchanger is provided under the heat exchanger. The drain water which collects in the drain pan is discharged to the outside using the inclination of a drain pipe connected to the drain pan, or is discharged to the outside by being suctioned by a built-in drain pump. In a case where a ceiling-mounted air conditioner or the like has difficulty in naturally discharging drain water using the inclination of the drain pipe, the drain water in the drain pan can be forcibly discharged to the outside using the drain pump (see Patent Literature 1, for example).

Under the Building Sanitation Law, meanwhile, the quality of water in the drain pan has to be checked as frequently as once a month, for example.

Water quality examination check on the drain pan and the vicinity of the suction port of the drain pump requires onerous work involving many steps, because the check is performed by taking the drain pan out of the air conditioner or by detaching some outer panels from the air conditioner. Thus, the water quality examination check is laborious work, and there has been a demand for simplifying the water quality examination check.

An air conditioner of Patent Literature 1 has been known as allowing the water quality examination check. In this air conditioner, an inspection window made of a transparent plate member is provided to a side wall of the drain pan, and an opening part through which the inspection window is visible is formed in a casing of the air conditioner. This air conditioner allows the drain pan to be visually examined from the opening part via the inspection window.

CITATION LIST

Patent Literature

Patent Literature 1: Japanese Patent Application Publication No. 2012-225524

SUMMARY OF INVENTION

Technical Problem

In the air conditioner of Patent Literature 1, however, it is difficult to perform the visual examination via the inspection window in a case where dirt adheres to the transparent plate member of the inspection window. The air conditioner of the Patent Literature 1 still requires onerous work such as performing the examination by detaching the drain pan from the air conditioner.

An object of the present invention is to provide an air conditioner which allows dirt in a drain pan to be visually examined without requiring onerous work.

Solution to Problem

The present invention is an air conditioner characterized in that the air conditioner includes: a housing; a drain pan provided inside the housing; a drain pump for suctioning drain water which collects in the drain pan; an opening part provided to a side surface of the housing; and a lid member attached to the opening part, and closing the opening part. The air conditioner is also characterized in that when the lid member is detached from the opening part, at least a part of the drain pan is visible from the opening part.

Advantageous Effects of Invention

According to the present invention, it is possible to obtain the air conditioner which allows dirt in the drain pan to be visually examined without requiring onerous work.

DESCRIPTION OF EMBODIMENTS

Hereinafter, embodiments of an air conditioner according to the present invention will be described with reference to the accompanying drawings. In the following descriptions, "front," "rear," "left," "right," "up," and "down" are based on directions shown in FIG. 1. Incidentally, the air conditioner to be shown as an example is a ceiling-mounted air conditioner. This, however, should not be construed as limiting the type of air conditioner to which the present invention is applied.

Figure 1:
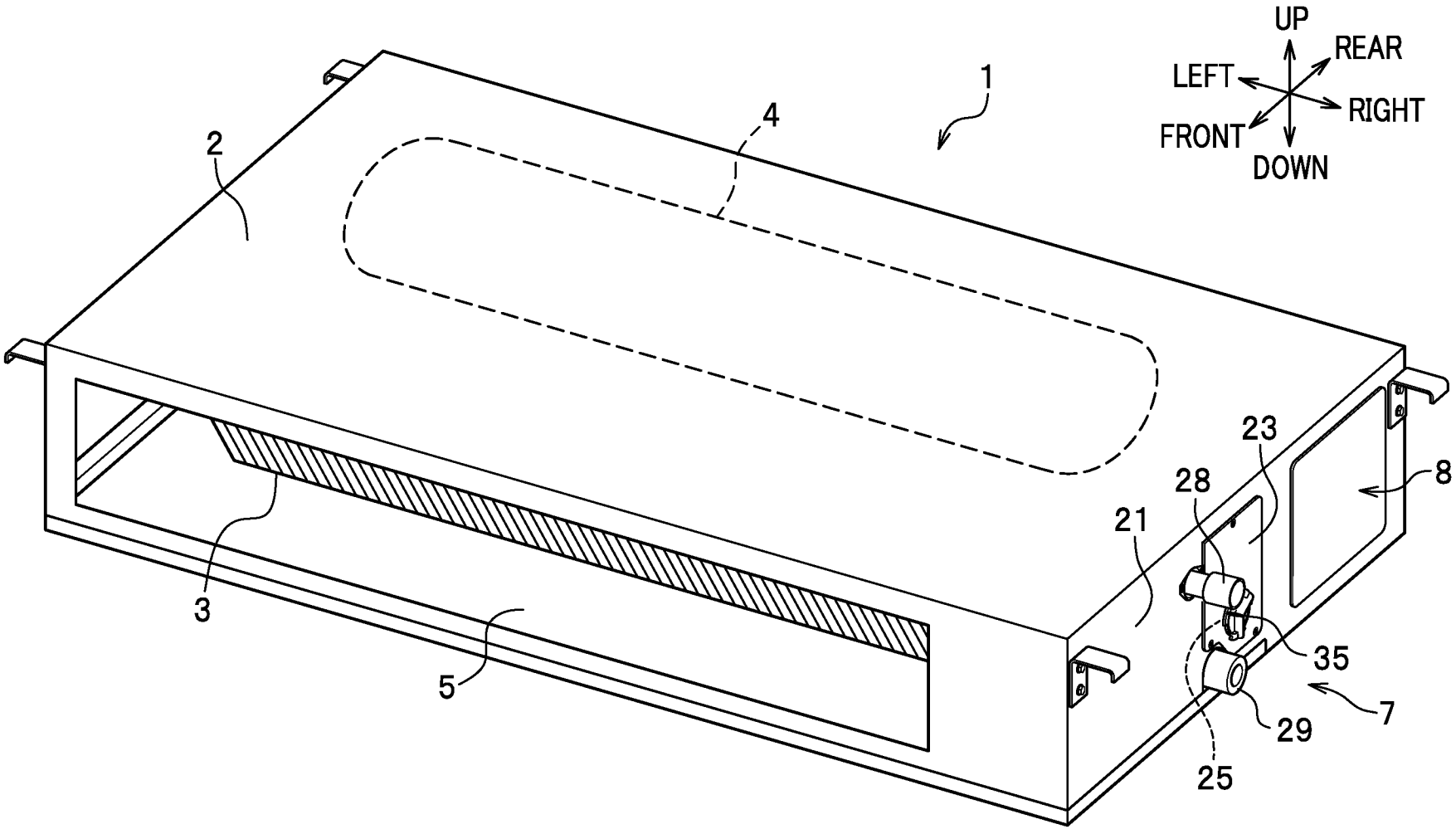
FIG. 1 is an external appearance perspective view illustrating an air conditioner according to an embodiment of the present invention.

As illustrated in FIG. 1, the air conditioner includes an indoor unit 1 and an outdoor unit (not illustrated). The indoor unit 1 includes a cabinet 2 as a housing. The indoor unit 1 includes an indoor heat exchanger (heat exchanger) 3, a fan 4, a drain pan 5, a drain pump 6 (see FIG. 3), a drain water discharging section 7, and an electric equipment section 8 inside the cabinet 2.

Figure 3:
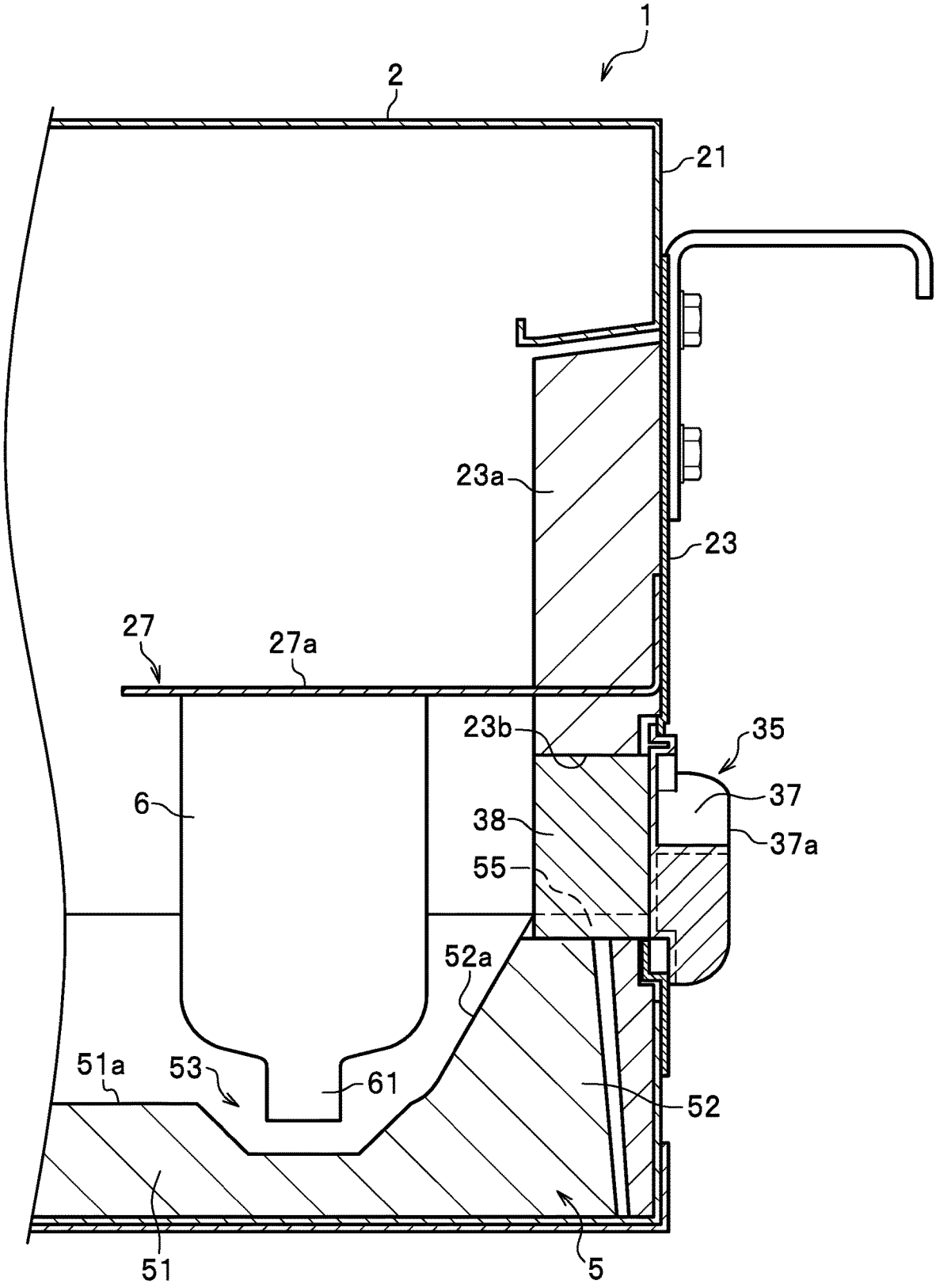
FIG. 3 is a cross-sectional view of the main part of the air conditioner taken along the A-A line in the FIG. 2.

The drain pan 5 is arranged under the heat exchanger 3. Drain water from the heat exchanger 3 flows into the drain pan 5. In a plan view, the drain pan 5 is formed substantially in the shape of a square (not illustrated), corresponding to the heat exchanger 3. As illustrated in FIG. 3, the drain pan 5 includes a bottom part 51, and a side wall part 52 rising from a peripheral edge portion of the bottom part 51. The drain pan 5 is made of a member which is less likely to cause dew condensation, for example, a resin-made foam material.

As illustrated in FIG. 3, a recessed part 53 is formed in the bottom part 51. The recessed part 53 is formed further deeper than a bottom surface 51*a* of the bottom part 51. Thus, the drain water flowing into the bottom part 51 collects inside the recessed part 53. A suction port 61 is arranged in the recessed part 53. The suction port 61 is cylindrically shaped, and is provided to a lower end portion of the drain pump 6. Thus, the drain water collecting in the recessed part 53 is discharged by the drain pump 6 to the outside of the drain pan 5 (the outside of the indoor unit 1).

As illustrated in FIG. 3, the side wall part 52 has a substantially trapezoidal cross-sectional shape. An inner surface 52*a* of the side wall part 52 descends toward the bottom surface 51*a*, and inclines to an inner side of the side wall part 52 (an inner side of the drain pan 5). In the embodiment, the inner surface 52*a* of the side wall part 52 located at the side of the recessed part 53 inclines to and continues to the recessed part 53 of the bottom part 51. Thus, the drain water flowing into the drain pan 5 smoothly corrects in (trickles down into) the recessed part 53.

Figure 4A:
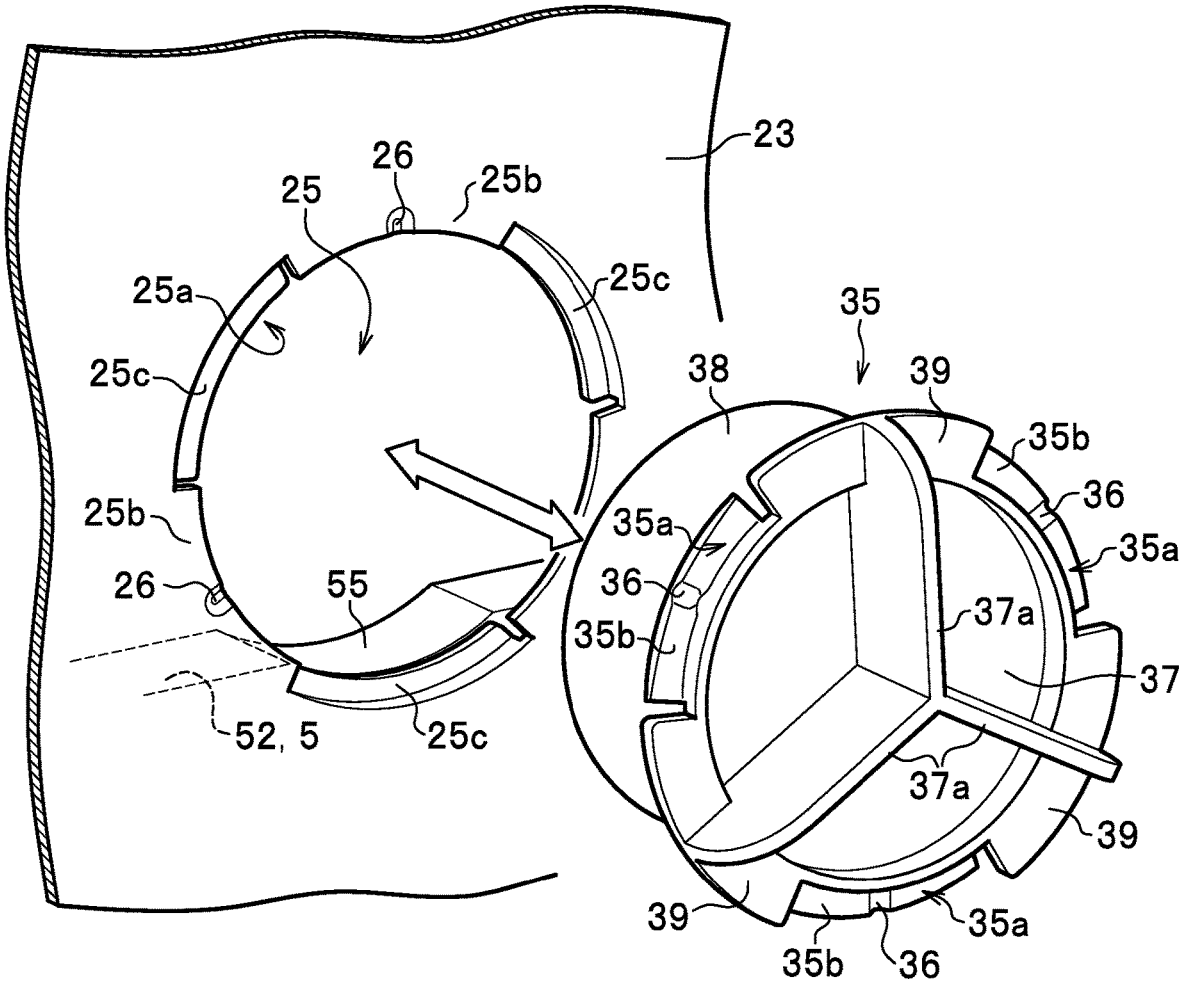
FIG. 4A is a perspective view illustrating an opening part and a lid member.
Figure 5:
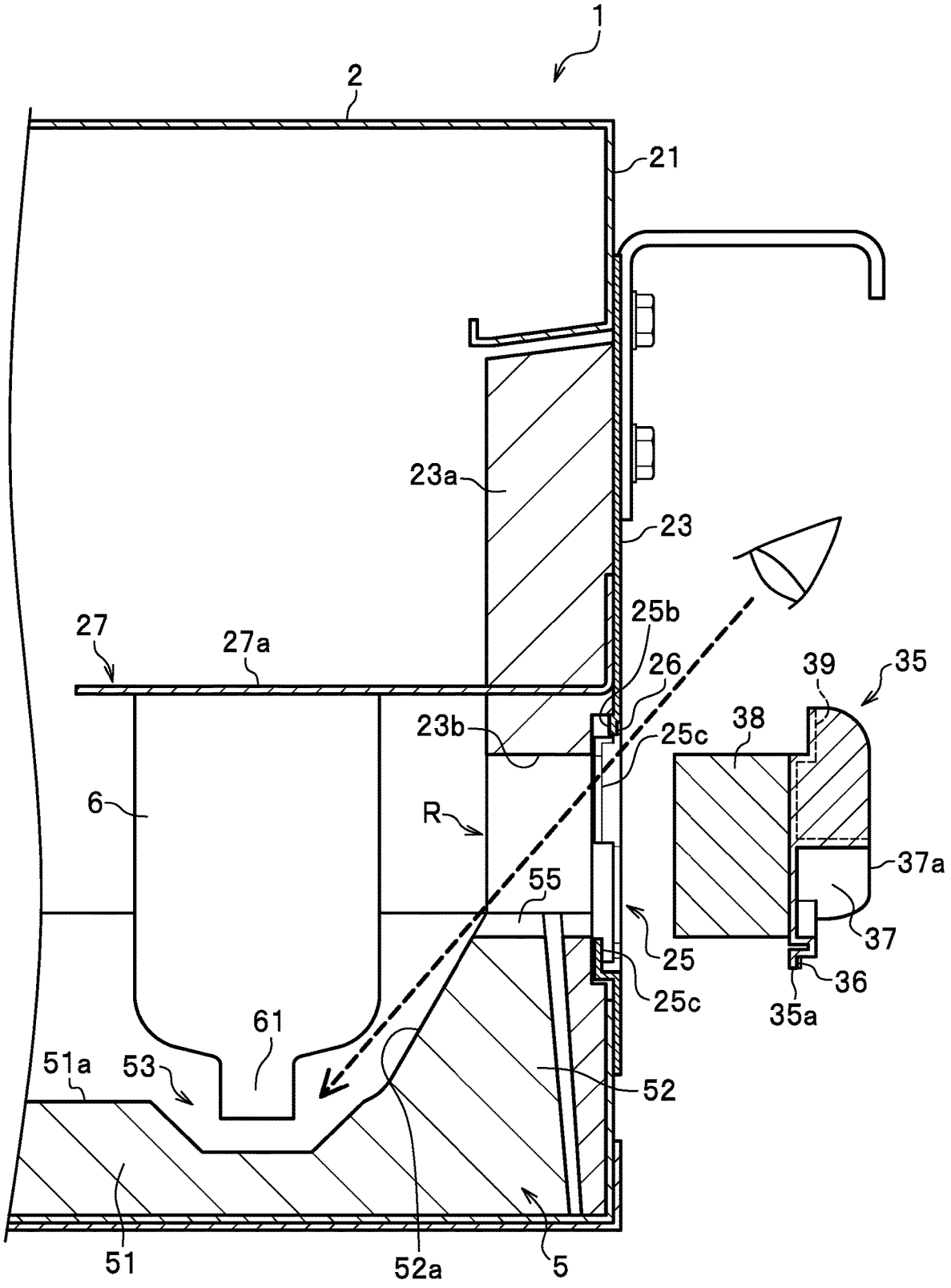
FIG. 5 is a cross-sectional view illustrating the air conditioner with the lid member detached from the opening part.

As illustrated in FIG. 4A, an arc-shaped recessed part 55 is formed in an upper end portion of the side wall part 52. As illustrated in FIG. 5, the arc-shaped recessed part 55 is formed in the shape of an arc, corresponding to an opening part 25 provided to a maintenance panel 23, which will be described later. The recessed part 55 forms a part of a check route R leading to the opening part 25. A part of an insertion part 38 of a lid member 35, although described later, is arranged in the recessed part 55 (see FIG. 3).

Figure 2:
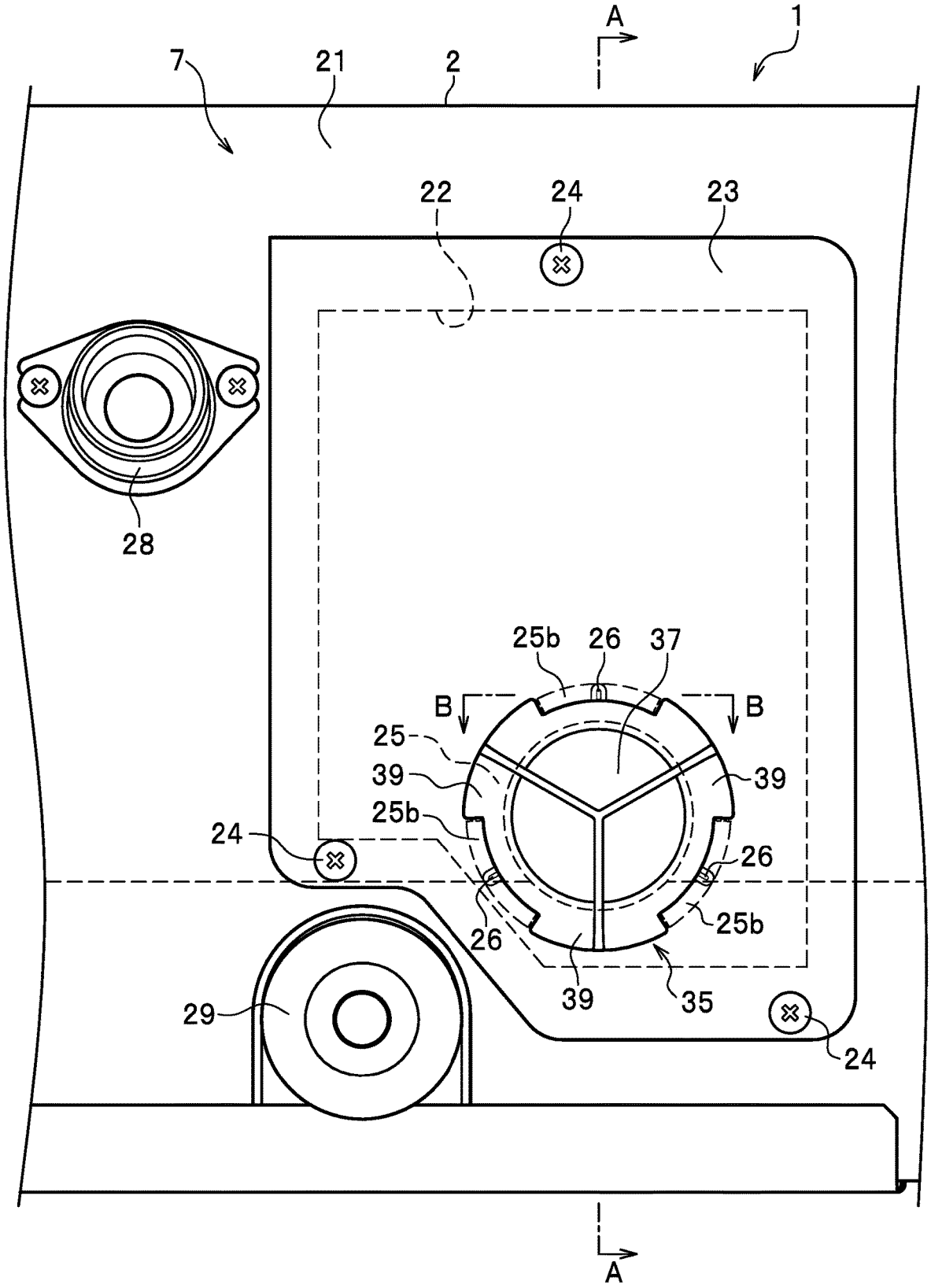
FIG. 2 is a side view illustrating a main part of the air conditioner.

As illustrated in FIG. 2, a maintenance opening part 22 (illustrated with dashed lines in the drawing) is formed and opened in an outer side plate 21 of the cabinet 2. The maintenance opening part 22 is closed with a maintenance panel 23. The maintenance panel 23 is fixed to an edge portion of the maintenance opening part 22, for example, using three screws 24. As illustrated in FIG. 3, a heat insulating material 23*a* is attached to an inner surface of the maintenance panel 23. The heat insulating material 23*a* may be formed, for example, from a resin-made foam material.

It should be noted that as illustrated in FIG. 2, the drain water discharging section 7 in the outer side plate 21 is provided with: a drain water discharging port 28 for discharging the drain water from the drain pump 6 (see FIG. 3); and a naturally discharging port 29 for naturally discharging the drain water from the drain pan 5 (see FIG. 3).

As illustrated in FIG. 4A, the opening part 25 is formed in the maintenance panel 23. The opening part 25 has a substantially circular shape in a side view (a substantially circular cross-sectional shape). The lid member 35 is detachably attached to the opening part 25 (see FIGS. 2 and 3). The lid member 35 has a substantially circular shape in a side view (a substantially circular cross-sectional shape), corresponding to the opening part 25. The opening part 25 is closed with the lid member 35, and is opened when the lid member 35 is detached from the opening part 25. On a side of the inner surface of the maintenance panel 23, as illustrated in FIG. 5, a cylindrical hole part 23*b* is formed in the heat insulating material 23*a*, corresponding to the circular shape of the opening part 25. The hole part 23*b* forms a main part of the check route R leading to the opening part 25. Incidentally, FIG. 4A omits the heat insulating material 23*a*.

The lid member 35 can be attached to and detached from the opening part 25 by being turned in a circumferential direction relative to the opening part 25. The lid member 35 has a tool-free structure which requires no tool to be used for the attachment and detachment. Detailed descriptions will be later provided for an attachment structure of the lid member 35.

In the embodiment, when the lid member 35 is detached from the opening part 25, as illustrated in FIG. 5, at least a part of the drain pan 5 can be visually examined from a side of the outer side plate 21, through the check route R from the opening part 25 (indicated with an arrow). To put it specifically, a part of the bottom surface 51*a* and the recessed part 53 in the drain pan 5, as well as the suction port 61 of the drain pump 6 can be visually examined. Although the side wall part 52 of the drain pan 5 is located in the check route R, the inner surface 52*a* of the side wall part 52 inclines as discussed above, and a substantially linear space is secured from the opening part 25 to the recessed part 53 via the check route R. Thereby, water quality can be examined and checked in the vicinity of the suction port 61 of the drain pump 6, including the recessed part 53 and its surroundings. Incidentally, since the recessed part 55 is formed in the upper end portion of the side wall part 52 of the drain pan 5, the space is accordingly wider than otherwise, and the visual examination is easy to perform.

It should be noted that the opening part 25 may be formed in a place on the maintenance panel 23 which allows at least a part of the drain pan 5 to be visually examined. It is desirable that the opening part 25 be formed in a place thereon which allows a part of the bottom surface 51*a* and the recessed part 53 in the drain pan 5, as well as the suction port 61 of the drain pump 6 to be visually examined. Furthermore, the opening part 25 may be formed with a size large enough for a hand or a finger to be inserted into the opening part 25 in order for at least a part of the drain pan 5 to be examined by touching them. It is desirable that the opening part 25 be formed with a size which allows a part of the bottom surface 51*a* and the recessed part 53 in the drain pan 5, as well as the suction port 61 of the drain pump 6 to be examined by touching them. In a case where the opening part 25 is formed with a minimum size, it is desirable that the size be large enough for a mechanic to insert at least two fingers (to perform the examination by touching).

Figure 4B:
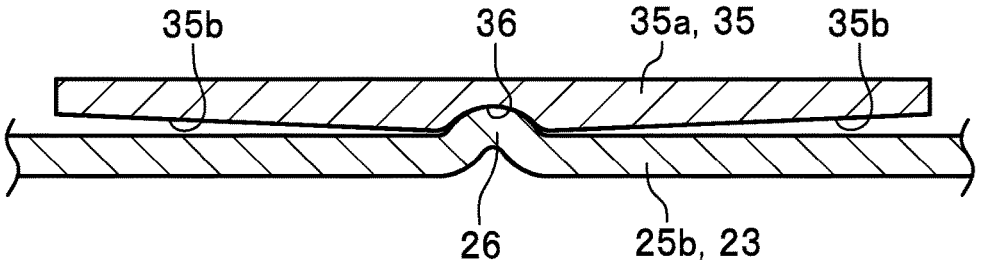
FIG. 4B is a magnified cross-sectional view of the main part of the air conditioner taken along the B-B line in the FIG. 2.

Next, referring to FIGS. 4A and 4B, descriptions will be provided for the attachment structure of the lid member 35.

As illustrated in FIG. 4A, engagement pieces 25*b* are formed in a hole edge 25*a* of the opening part 25. Each engagement piece 25*b* extends in a circumferential direction of the hole edge 25*a*. A total of three engagement pieces 25*b* are formed at intervals of 60 degrees in the circumferential direction. An engagement projecting part 26 is formed in a circumferential direction central portion of each engagement piece 25*b*. The engagement projecting part 26 is a small protrusion which projects toward the inside of the maintenance panel 23, as illustrated in FIG. 4B.

It should be noted that the engagement piece 25*b* corresponds to an "edge portion of an opening part" in the scope of claims.

Meanwhile, the lid member 35 includes a lid part 37 and the insertion part 38. The lid part 37 has a substantially circular shape in a side view. Three radially-arranged ribs 37*a* are projectingly provided to a side surface of the lid part 37. The ribs 37*a* each function as a pinch for turning the lid member 35. The ribs 37*a* are projectingly provided at intervals of 60 degrees in a circumferential direction.

Projecting pieces 35*a* are formed in an outer circumferential edge portion of the lid member 35. The projecting pieces 35*a* extend in a circumferential direction of the outer circumferential edge portion, and can come into contact with the engagement pieces 25*b* of the opening part 25 such that the projecting pieces 35*a* respectively face the engagement pieces 25*b* from inside. A total of three projecting pieces 35*a* are formed at intervals of 60 degree in the circumferential direction. The projecting pieces 35*a* can be respectively arranged in gap parts 25*c* formed between the engagement pieces 25*b* of the opening part 25. Incidentally, the gap parts 25*c* are formed when the maintenance panel 23 is formed.

As illustrated in FIG. 4B, in each projecting piece 35*a*, side surfaces 35*b* incline toward a circumferential direction central portion of the projecting piece 35*a*, in the shape of a mountain. An engagement receiving part 36 is formed in the central portion of each projecting piece 35*a*. The engagement projecting part 26 of the corresponding engagement piece 25*b* of the opening part 25 can come into engagement with the engagement receiving part 36.

This engagement stops the lid member 35 from turning relative to the opening part 25. Furthermore, when the engagement projecting parts 26 are brought out of engagement with the respective engagement receiving part 36 (by the turning of the lid member 35), the lid member 35 is set free from being stopped from turning relative to the opening part 25. This release enables the lid member 35 to be detached from the opening part 25.

It should be noted that each projecting piece 35*a* corresponds to an "engagement part" in the scope of claims.

As illustrated in FIG. 4A, contact pieces 39 adjoining the projecting pieces 35*a* are formed in the outer circumferential edge portion of the lid member 35. As illustrated in FIG. 2, the contact pieces 39 come into contact with the hole edge portion of the opening part 25. The lid member 35 is held by the contact pieces 39 to the hole edge portion of the opening part 25 without coming off the hole edge portion into the opening part 25.

The insertion part 38 has a columnar shape. The insertion part 38 is formed from a material similar to that of the heat insulating material 23*a* of the maintenance panel 23. As illustrated in FIG. 3, the insertion part 38 is arranged in the hole part 23*b* of the heat insulating material 23*a*. A part of the insertion part 38 is arranged in the recessed part 55 of the side wall part 52 of the drain pan 5.

As illustrated in FIG. 3, a support member 27 having a substantially L-shape is attached to the inner surface of the maintenance panel 23. The support member 27 includes an extension part 27*a* which extends toward the inside (left side) of the maintenance panel 23. The drain pump 6 is attached to the extension part 27*a*. The drain pump 6 is joined to the maintenance panel 23 with the assistance of the support member 27 in advance. Thus, when the maintenance panel 23 is fixed to the outer side plate 21, the drain pump 6 can be arranged in a predetermined location inside the cabinet 2. Furthermore, in case of maintenance, when the maintenance panel 23 is detached from the outer side plate 21, the drain pump 6 can be detached together with the maintenance panel 23. The drain pump 6, therefore, is excellent in assemblability and maintainability.

Next, descriptions will be provided for a procedure for a water quality examination check.

In the water quality examination check, first of all, the lid member 35 is detached from the opening part 25. To this end, the ribs 37*a* of the lid member 35 are held by fingers, and the lid member 35 is turned in a circumferential direction (in a clockwise direction, or in a counterclockwise direction). Thus, the projecting pieces 35*a* of the lid member 35 moves in the circumferential direction relative to the engagement pieces 25*b* of the opening part 25. Thereby, the engagement projecting parts 26 are released from engagement (see FIG. 4B) with the engagement receiving parts 36.

Thereafter, the lid member 35 is turned to a position which makes the projecting pieces 35*a* of the lid member 35 come out of engagement with the engagement pieces 25*b* of the opening part 25, that is to say, to a position which makes the projecting pieces 35*a* of the lid member 35 come to be located in the gap parts 25*c*. Subsequently, the ribs 37*a* of the lid member 35 are pinched with fingers, and the lid member 35 is pulled out of the opening part 25 toward the front in the axial direction (toward the outside of the outer side plate 21 of the cabinet 2) (see FIGS. 4A and 5). Thus, the lid member 35 is detached from the opening part 25. Because of the detachment of the lid member 35, the check route R is formed inside the opening part 25 (see FIG. 5).

After that, the mechanic puts his/her face near the opening part 25, and looks into the inside from the opening part 25 while illuminating the inside with a lamp. Thereby, the mechanic visually examines a part of the drain pan 5 and the vicinity of the suction port 61 of the drain pump 6 through the check route R. Then, the mechanic inserts his/her hand and fingers from the opening part 25, and examines the drain pan 5 (the recessed part 53) and the vicinity of the suction port 61 of the drain pump 6 by touching them. Incidentally, the mechanic may perform the examination by inserting a rod-shaped tool and the like from the opening part 25 in addition to his/her hand and fingers.

After the completion of the water quality examination check by the visual examination and the tactile examination, the ribs 37*a* of the lid member 35 is pinched with fingers, and the insertion part 38 of the lid member 35 is inserted into the opening part 25.

Thereafter, the projecting pieces 35*a* of the lid member 35 are inserted into the gap parts 25*c* of the opening part 25, and the lid member 35 is turned in the circumferential direction.

Thereby, the projecting pieces 35*a* of the lid member 35 come to overlap the engagement pieces 25*b* of the opening part 25. Thereafter, the engagement projecting parts 26 of the engagement pieces 25*b* come into engagement with the engagement receiving parts 36 of the projecting pieces 35*a* (see FIG. 4B). Thereby, the lid member 35 is fixed to the opening part 25 in a way that stops the turning of the lid member 35.

The water quality examination check ends with the above.

It should be noted that the maintenance of the drain pump 6 and the inside of the indoor unit 1 can be performed by: detaching the maintenance panel 23; and thereby opening the maintenance opening part 22. In this case, the drain pump 6 can be detached by only the detecting of the maintenance panel 23. The maintenance, therefore, can be performed by work requiring no onerous steps.

In the water quality examination check, the air conditioner according to the above-discussed embodiment enables at least a part of the drain pan 5, the recessed part 53, and the suction port 61 of the drain pump 6 to be visually examined through the check route R which is formed when the lid member 35 is detached from the opening part 25. The air conditioner further enables at least a part of the drain pan 5, the recessed part 53, and the suction port 61 of the drain pump 6 to be examined by touching them with a hand and fingers which are inserted into the cabinet 2 (into the inside of the outer side plate 21) via the check route R.

It should be noted that in a case of the indoor unit 1 having a structure in which the drain pump 6 is not arranged near the opening part 25, at least a part (a main part) of the drain pan 5 can be examined visually and by touching them through the check route R.

In addition, the lid member 35 can be attached and detached without using any tool. The attachment and the detachment can be performed by turning the lid member 35 relative to the opening part 25 in the circumferential direction. The lid member 35, therefore, is easy to attach and detach even in a narrow space such as a space above the ceiling. This makes the maintainability excellent.

Furthermore, since the opening part 25 is provided to the maintenance panel 23, the heat insulating material 23*a* can be more easily installed than in a case where the opening part 25 is provided to any other part of the outer side plate 21. This makes the productivity excellent. Moreover, since the other part of the outer side plate 21 can be integrally covered with the heat insulating material 23*a*, more costs can be reduced than in a case where multiple heat insulating materials 23*a* with a smaller dimension are installed. Besides, the other part of the outer side plate 21 can be integrally covered with the heat insulating material 23*a*. This enhances the heat insulation properties.

What is more, since at least a part of the insertion part 38 of the lid member 35 is arranged in the recessed part 55 of the side wall part 52 of the drain pan 5, the height of the side wall part 52 can be secured, and a space examinable visually and by touching it can be preferably secured. This makes the maintainability excellent.

In addition, since the inner surface 52*a* of the side wall part 52 of the drain pan 5 inclines toward the inside of the drain pan 5, the space examinable visually and by touching it can be made accordingly wider. This makes the maintainability excellent.

Although the foregoing descriptions have been provided for the embodiment of the present invention, the present invention is not limited to the embodiment, and can be modified depending on the necessity within a scope not departing from the gist or spirit of the present invention.

For example, although the embodiment has discussed the attachment structure in which the lid member 35 is attached to and detached from the opening part 25 by being turned relative to the opening part 25 in the circumferential direction, the present invention is not limited to this. The lid member 35 may have a structure with which the lid member 35 is attached to the opening part 25 by being slid over the side surface of the outer side plate 21.

Furthermore, the embodiment has discussed the structure in which the drain pump 6 is arranged at the side of the opening part 25, the present invention is not limited to this. The drain pump 6 may be arranged by being offset in a direction forward or rearward of the opening part 25. Otherwise, the drain pump 6 may be arranged in a location far from the opening part 25.

Although the embodiment has discussed the structure in which the drain pump 6 is integrally attached to the maintenance panel 23, the present invention is not limited to this. The drain pump 6 may be supported by a part other than the maintenance panel 23.

REFERENCE SIGNS LIST

1 indoor unit
2 cabinet (housing)
5 drain pan
6 drain pump
21 side plate part (side surface)
22 maintenance opening part
23 maintenance panel
23 opening part
25*b* engagement piece (edge portion of opening part)
35 lid member
35*b* projecting piece (engagement part)
51 bottom part
52 side wall part
53 recessed part
61 suction port
R check route

The invention claimed is:

1. An air conditioner comprising:
a housing;
a drain pan disposed inside the housing;
a drain pump for suctioning drain water which collects in the drain pan;
an opening part provided to a side surface of the housing; and
a lid member, detachably attached to the opening part, for the closing the opening part,
wherein when the lid member is detached from the opening part, at least a part of the drain pan is visible through a line of sight from the opening part,
wherein the drain pan includes a bottom part, and a side wall part rising from the bottom part,
wherein a recessed portion is disposed in an uppermost top surface of the side wall part, and
when the lid member is attached to the opening part, at least a part of the lid member is disposed in the recessed part.

2. The air conditioner according to claim 1, wherein
the opening part has a substantially circular cross-sectional shape,
the lid member has a substantially circular cross-sectional shape, corresponding to the opening part, and
a peripheral edge portion of the lid member is provided with an engagement part which comes into engagement with an edge portion of the opening part by being turned in a circumferential direction.

3. The air conditioner according to claim 1, wherein
when the lid member is detached from the opening part, a suction port of the drain pump is visible through the line of sight from the opening part.

4. The air conditioner according to claim 1, further comprising:
a maintenance opening part in the housing; and
a maintenance panel for closing the maintenance opening part, wherein
the opening part is disposed in the maintenance panel.

5. The air conditioner according to claim 1,
wherein an inner surface of the side wall part inclines toward an inside of the drain pan from a bottom of a curved surface of the recessed part.

* * * * *